US005316315A

United States Patent [19]

Roark, Jr.

[11] Patent Number: 5,316,315

[45] Date of Patent: May 31, 1994

[54] POOLSIDE ANCHORING SYSTEM AND METHOD

[76] Inventor: John L. Roark, Jr., 19 Robinwood St., Brownsburg, Ind. 46112

[21] Appl. No.: 104,856

[22] Filed: Aug. 10, 1993

[51] Int. Cl.[5] ..... A63B 71/00

[52] U.S. Cl. ..... 273/411; 52/169.7; 273/1.5 R

[58] Field of Search ..... 273/411, 1.5 R, 1.5 A; 52/169.7, 169.8; 4/488

[56] References Cited

U.S. PATENT DOCUMENTS

| | | | |
|---|---|---|---|
| 814,074 | 3/1906 | Conkling | 273/411 |
| 3,582,078 | 6/1971 | Katras | 273/411 X |
| 3,820,174 | 6/1974 | Rozanski | 52/169.7 |
| 4,307,887 | 12/1981 | Weiss | 273/411 |
| 4,715,599 | 12/1987 | Raymond et al. | 273/1.5 R |
| 5,037,093 | 8/1991 | Roark, Jr. | 273/1.5 R |
| 5,112,023 | 5/1992 | Sowers | 273/1.5 R X |
| 5,149,086 | 9/1992 | Ziff | 273/1.5 R |

*Primary Examiner*—William H. Grieb
*Attorney, Agent, or Firm*—Woodard, Emhardt, Naughton, Moriarty & McNett

[57] ABSTRACT

An anchoring system for mounting volleyball nets, basketball goals and the like to the deck of a pool is disclosed that includes metal support poles having a diameter in the range of about 1.85 to 1.95 inches for receipt in corresponding built-in anchors mounted flush with the deck of the pool. The anchors and support poles match those of other non-netted pool accessories so that the volleyball nets and basketball goals are interchangeable with pre-existing anchors to eliminate retrofit and/or drilling or casting of new anchors in the pool deck. The support poles can be received at a fixed height supported clamped by the anchor or can include adjustable means for adjusting the height of the volleyball net or basketball goal. Also disclosed is a reinforced volleyball net and adjustable telescoping attachment means particularly suited for poolside volleyball.

18 Claims, 5 Drawing Sheets

POOLSIDE ANCHORING SYSTEM AND METHOD

BACKGROUND OF THE INVENTION

This invention relates generally to anchoring systems for netted poolside water sport game pieces and, more particularly, to a netted game piece such as a volleyball net or basketball goal mounted to a rigid support member that is specifically constructed and sized for receipt in a built-in adjustable anchor installed flush with the deck of a pool.

As swimming pools have become more popularly used for netted water sports such as volleyball, basketball and water polo, the need for an improved anchoring system has developed for supporting the volleyball and water polo nets and basketball goals from the deck of the pool. In many cases, near constant depth activity pools dedicated to netted water sports have replaced the traditional shallow end/diving end pools for new family dwellings. As such, greater demand has been placed for a poolside netted water sport game piece and anchoring system that can resist the rigors of near constant use, rather than the mere occasional use as was previously the case.

Present support systems, such as that disclosed in my prior U.S. Pat. No. 5,037,093, employ an adjustable anchor embedded in concrete which is typically deeper than the concrete making up the surrounding sidewalk or deck. Although such an anchor provides a rigid support for an installed basketball goal as disclosed, the anchor is nevertheless difficult to install and, because it is raised from the concrete to provide access to the adjusting means, also poses an obstruction to poolside traffic when the basketball goal is removed.

Simple flush mounted plastic tubing is known for use as a poolside anchor; however, the tubing does not include means for clamping to and/or adjusting the netted game piece relative to the anchor. As a result, the outer diameter of the game piece support pole must be sized very near to the inner diameter of the anchor tubing to provide a rigid support for the netted game piece. However, it is difficult to find such a close fitting relationship among the limited standard sizes of plastic and metal tubing readily available. As such, specially sized and matched tubing is required to provide a rigid support system for the netted game piece, further increasing the cost and difficulty of its installation as well as detracting from its interchangability with other anchors and/or netted game pieces.

Therefore, a need exists for an improved poolside netted water sport game piece and anchoring system that overcomes the above-noted deficiencies and meets the rigorous demands imposed by water sport activity pools. Preferably, the anchoring system should be flush mounted and include clamping means, as well as be sized having a common diameter to promote interchangability with other game pieces. Further, it is also desirable that the netted game piece be specifically sized for use with existing adjustable flush-mounted anchors presently used to support non-netted pool accessories such as ladders, lane markers and the like.

SUMMARY OF THE INVENTION

According to one embodiment of the present invention, a support system is disclosed for mounting a netted water sport game piece from a deck of a pool, comprising a netted water sport game piece adapted for recreational use with a pool, a first elongated member for supporting the netted water sport game piece from at least one edge of the pool, the first elongated member including a cylindrical portion having a diameter in the range of about 1.85 to 1.95 inches, means for mounting the netted water sport game piece to the first elongated member, and a built-in anchor mounted in the deck of the pool, the built-in anchor including a top surface disposed substantially flush with the deck of the pool, a longitudinal bore extending downwardly from the top surface, the longitudinal bore having a predetermined common diameter sized for receiving the cylindrical portion therein, and an adjustable clamp accessible from the top surface for clamping the cylindrical portion in place in the longitudinal bore.

According to another embodiment of the present invention, a support system for mounting a volleyball net from a deck of a pool is disclosed comprising a volleyball net adapted for recreational use with a pool, first telescoping means for adjustably supporting an end of the volleyball net above the pool, second telescoping means for adjustably supporting the other end of the volleyball net above the pool, means for mounting the volleyball net between the first and second telescoping means, and anchor means mounted in the deck of the pool for anchoring the first and the second telescoping means to the deck of the pool.

According to another embodiment of the present invention, a method for mounting a netted water sport game piece from a deck of a pool is disclosed comprising the steps of (a) obtaining a netted water sport game piece adapted for recreational use with a pool, the game piece being mounted to a first elongated member that includes a cylindrical portion having a diameter in the range of about 1.85 to 1.95 inches, (b) inserting the cylindrical portion into a built-in anchor mounted in the deck of the pool, the built-in anchor including a top surface disposed substantially flush with the deck of the pool, a downwardly extending longitudinal bore having a predetermined common diameter sized for receiving the cylindrical portion, and an adjustable clamp accessible from the top surface for clamping the cylindrical portion in place in the longitudinal bore, and (c) adjusting the adjustable clamp to clamp the cylindrical portion in place in the longitudinal bore.

One object of the present invention is to provide an improved poolside netted water sport game piece and anchoring system that meets the rigorous demands imposed by activity pools.

Another object of the present invention is to provide a poolside netted water sport game piece and anchoring system sized having a common diameter to facilitate interchangeability.

Yet another object of the present invention is to provide a poolside netted water sport game piece and anchoring system sized common with existing built-in anchors installed in the deck of a pool for supporting non-netted pool accessories such as ladders, lane markers and the like.

Still yet another object of the present invention is to provide an improved poolside volleyball net.

Another object of the present invention is to provide a support system for a volleyball net that is adjustable to vary the height of the net above a pool.

Yet another object of the present invention is to provide an anchor for mounting netted water sport game pieces from a deck of a pool that is flush mounted with the deck of the pool so as not to present an obstacle when the netted water sport game pieces are removed.

These and other related objects and advantages will become apparent from the following drawings and written description.

DESCRIPTION OF THE PREFERRED EMBODIMENT

Figure 1:
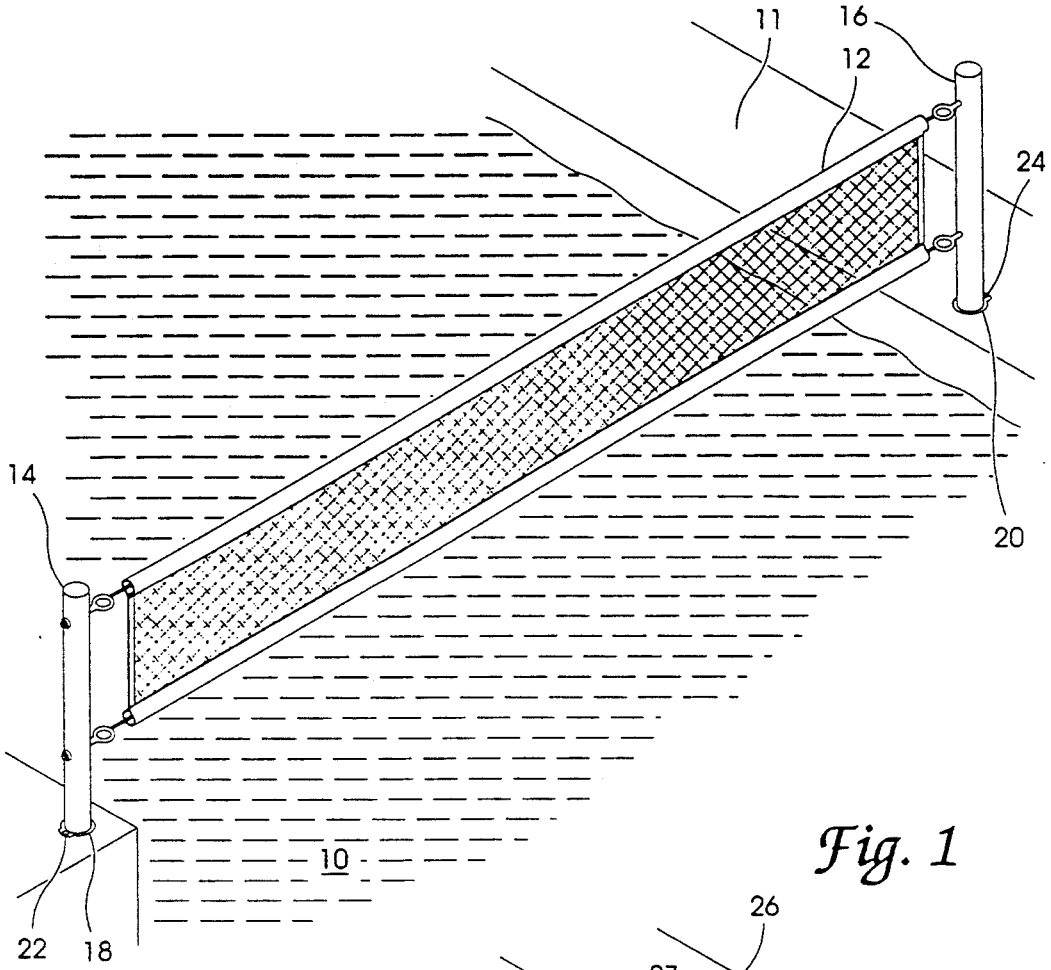
FIG. 1 is a perspective view of a volleyball net installed in adjustable flush-mounted anchors according to one embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
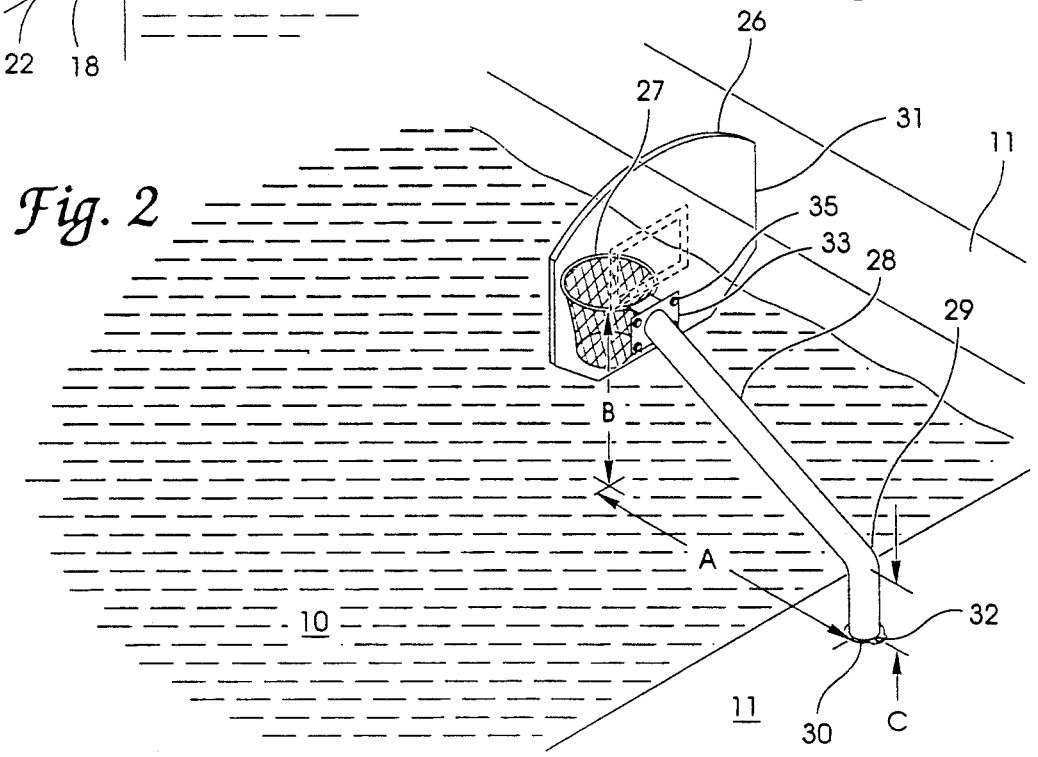
FIG. 2 is a perspective view of a basketball goal installed in an adjustable flush-mounted anchor according to another embodiment of the present invention.

Referring now to FIGS. 1 and 2, various netted water sport game pieces are shown adapted for recreational use with a pool. In FIG. 1, a volleyball net 12 is shown mounted across pool 10 between support poles 14 and 16. Support poles 14 and 16 are slideably received in built-in anchors 18 and 20, respectively, and clamped in place therein by adjustable clamps 22 and 24. Tie down hooks connect between eyelets of the support poles 14 and 16 and net 12 to provide means for mounting the volleyball net to the support poles, as hereinafter discussed in greater detail in connection with FIG. 7.

Similarly, in FIG. 2 a poolside basketball goal 26 is shown mounted to a support pole 28 extending over pool 10. Support pole 28 is slideably received in a built-in anchor 30 and clamped in place therein by an adjustable clamp 32. In one specific embodiment, support pole 28 extends horizontally a distance 'A' to support the center of rim 27 approximately 36 inches inwardly over pool 10 from anchor 30 and extends vertically a distance 'B' to support rim 27 approximately 46 inches above anchor 30 and deck 11. In this specific embodiment, support pole 28 includes a 45 degree bend at location 29 at a distance 'C' approximately 8 inches vertically above anchor 30 and deck 11. Support pole 28 attaches to backboard 31 at a 45 degree angle via conventional mounting means such as mounting bracket 33 and bolts 35.

The volleyball net and basketball goal shown in FIGS. 1 and 2 are representative of common netted game pieces for use with a pool, particularly an in-ground activity pool. Other netted poolside game pieces are nevertheless contemplated that are constructed and sized for use with anchors built into the deck of a pool and include, but are not limited to, for example water polo nets.

Volleyball net 12 and basketball goal 26 represent an improvement over prior poolside nets and goals in that the support poles are specifically constructed and sized for use with built-in anchors employed with other non-netted poolside accessories, such as those built-in anchors employed for supporting poolside ladders, hand rails, diving boards and buoyed lane markers and pool dividers. In particular, these non-netted poolside accessory anchors are sized for receiving 1.90 diameter tubing and are available from Frost Company, 6525 14th Avenue, Kenosha, Wis., 53143-4908. As such, support poles 14, 16 and 28 are preferably constructed having an outer diameter in the range of about 1.85 to 1.95 inches for optimal receipt in the aforementioned anchors. In one specific embodiment, support poles 14, 16 and 28 are constructed from 0.145 inch guage stainless steel tubing having an outer diameter of 1.90 inches. Such tubing is commonly used in the construction of poolside ladders, hand rails, diving boards supports and buoyed lane marker and pool divider supports and is available from Kilsby-Roberts, 2300 S. Tibbs, Indianapolis, Ind., 46241.

Prior netted game pieces have typically been constructed from plastic tubing such as polyvinyl chloride (PVC). The PVC tubing comes in various standard sizes, typically 1.5 inch and 2.0 inch diameters in the size range of the present invention.

The 2.0 inch diameter PVC tubing is too large to fit in built-in anchors 18, 20 and 30, while the 1.5 inch diameter PVC tubing is too small to provide a close fitting rigid support when clamped in anchors 18, 20 or 30. As such, the standard size PVC tubing requires a special anchor not readily available for aftermarket installation. Further, although perhaps acceptable for occasional use, the PVC tubing is not sufficiently rigid for dedicated use with an activity pool.

The present invention overcomes the deficiencies of PVC tubing and the like by using support poles which are constructed of the same material strength and size as the above-mentioned 1.90 inch diameter stainless steel tubing used with non-netted poolside accessories. Because standard anchors sized for receiving the 1.90 inch diameter tubing are readily available, the present invention provides a more versatile, universal anchoring system for mounting netted water sport game pieces from the deck of a pool. In particular, many in-ground pools are constructed having built-in anchors cast in place at various locations in the deck of a pool. Common anchor locations for an in-ground pool include near the end of the pool for supporting a ladder and/or hand rail and across the mid-portion of the pool for supporting a lane marker and/or pool divider. The present invention is usable with these standard built-in anchor locations without retrofit or otherwise aftermarket drilling and/or casting.

For example, in one application the basketball goal support pole is inserted and clamped into an anchor near the end of the pool, while in another application support poles for a volleyball net are installed and clamped into anchors across the mid-portion of the pool. The present invention is also an improvement when initially constructing an in-ground pool. Because the built-in anchors are readily available for installation at the various ladder, hand rail and lane marker locations, additional anchors are easily installed at other locations adjacent to the pool during its construction.

Figure 3:
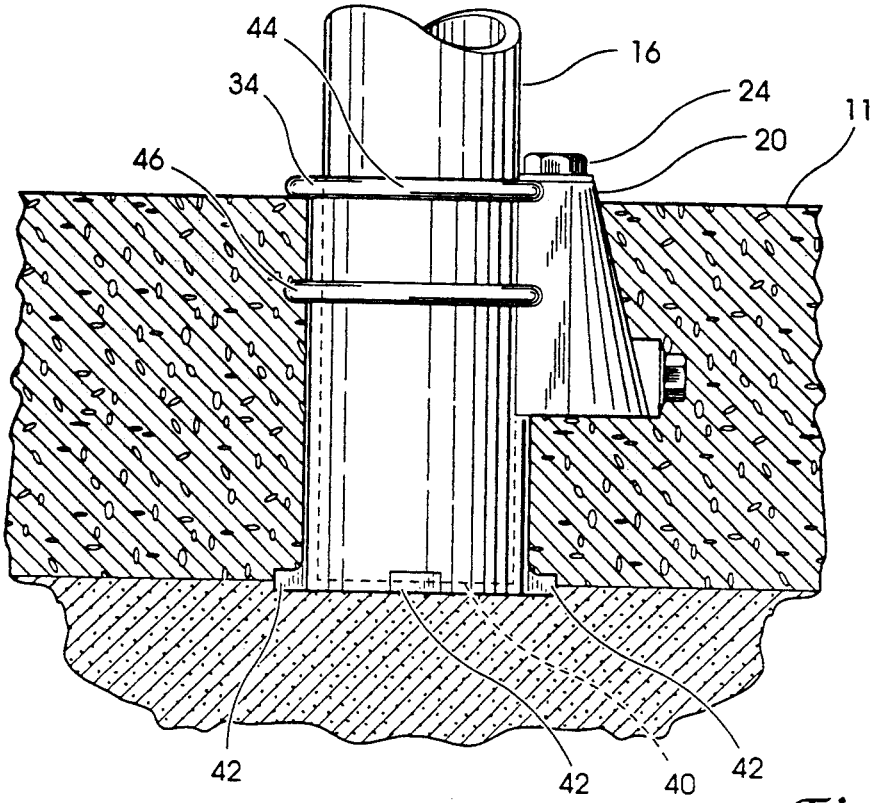
FIG. 3 is a side elevational, partial cross-sectional view of a built-in anchor for use with the volleyball net and basketball goal shown in FIGS. 1 and 2, respectively.
Figure 4:
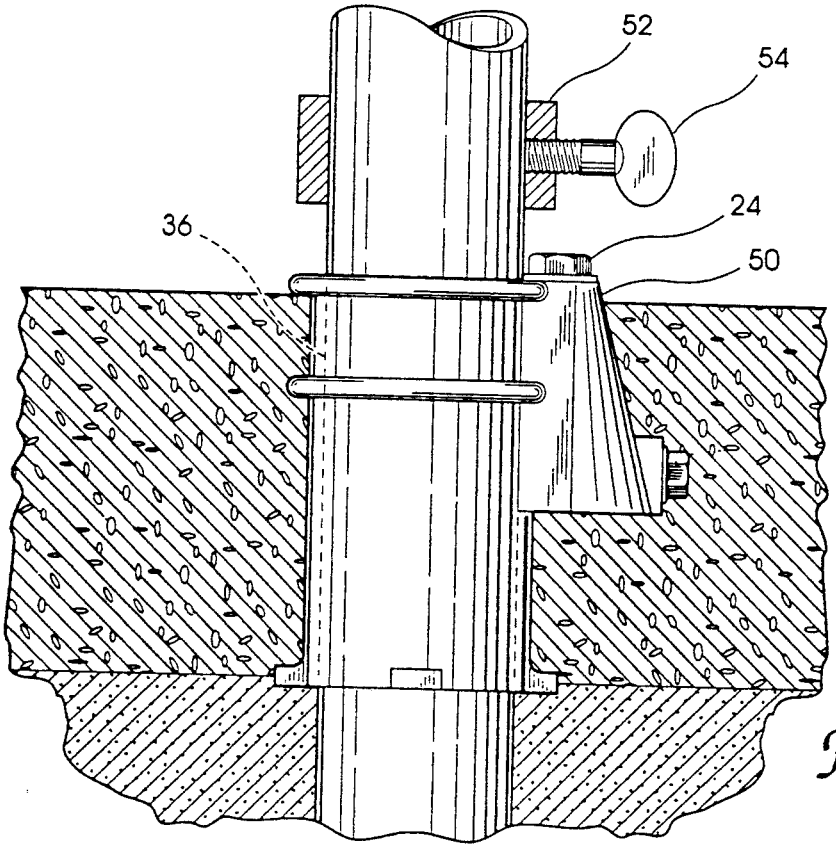
FIG. 4 is a side elevational, partial cross-sectional view of an alternate built-in anchor for use with the basketball goal shown in FIG. 2.

Referring now to FIGS. 3 and 4, built-in anchors for use with the volleyball net of FIG. 1 and/or the basketball goal of FIG. 2 are shown in greater detail. In FIG. 3, anchor 20 is shown cast in deck 11 across from anchor 18 (FIG. 1). Anchor 20 includes a top surface 34 disposed substantially flush with deck 11. A longitudinal bore 36 extends downwardly from top surface 34 and is sized having a diameter slightly larger than that of the support pole tubing to slideably receive support pole 16 therein. As previously mentioned, support pole 16 is constructed having a diameter in the range of about 1.85 to 1.95 inches, preferably 1.90 inches. Support pole 14 is similarly constructed and sized for like receipt in anchor 18.

An adjustable clamp 24 is accessible from top surface 34 for clamping support pole 16 in place in longitudinal bore 36. Anchor 20 further includes a bottom surface 40 for supporting support pole 16 at a particular elevation above deck 11. Bottom surface 40 includes a drainage hole 41 (FIG. 5) to prevent any build-up of debris that might detract from the clamping action of anchor 20. Four feet or tabs 42 extend radially outward from bottom surface 40 to index anchor 20 relative to deck 11 when cast in place therein for added structural rigidity. Similarly, ridges 44 and 46 are provided peripherally around anchor 20 to further index and cooperate with the cast concrete when cast in deck 11 to provide additional rigidity.

Referring now to FIG. 4, an alternate anchor 50 is shown for use with either support poles 14 and 16 or support pole 28 to provide vertical adjustment of the netted game piece relative to the deck of the pool. A collar 52 is slideably disposed along the support pole and includes a thumbscrew 54 as locking means for selectively locking the collar in place along the support pole. Longitudinal bore 36 extends through bottom surface 40 of anchor 50 so that the support pole can adjust below the anchor. By adjusting collar 52 along the support pole using thumbscrew 54, the height of the netted game piece mounted to the support pole can be adjusted above anchor 50. In this embodiment, clamp 24 is adjustable to fix the angular rotation of the support pole within anchor 50, while thumbscrew 54 is adjustable to fix the height of the support pole above the anchor. As such, collar 52 functions similarly to the support pole and collar disclosed in my prior U.S. Pat. No. 5,037,093 issued on Aug. 6, 1991, the disclosure of which is hereby incorporated by reference.

Figure 5:
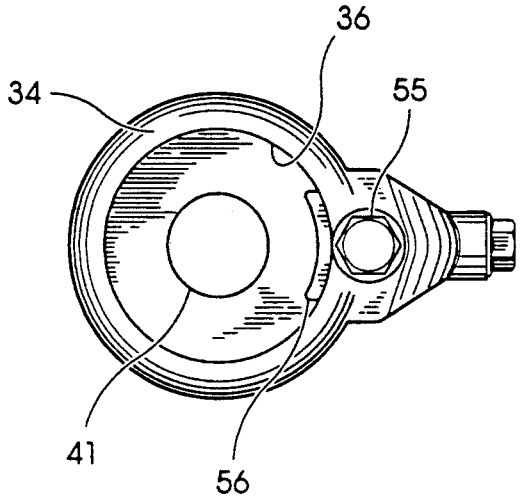
FIG. 5 is a top plan view of the built-in anchor shown in FIG. 3.
Figure 6:
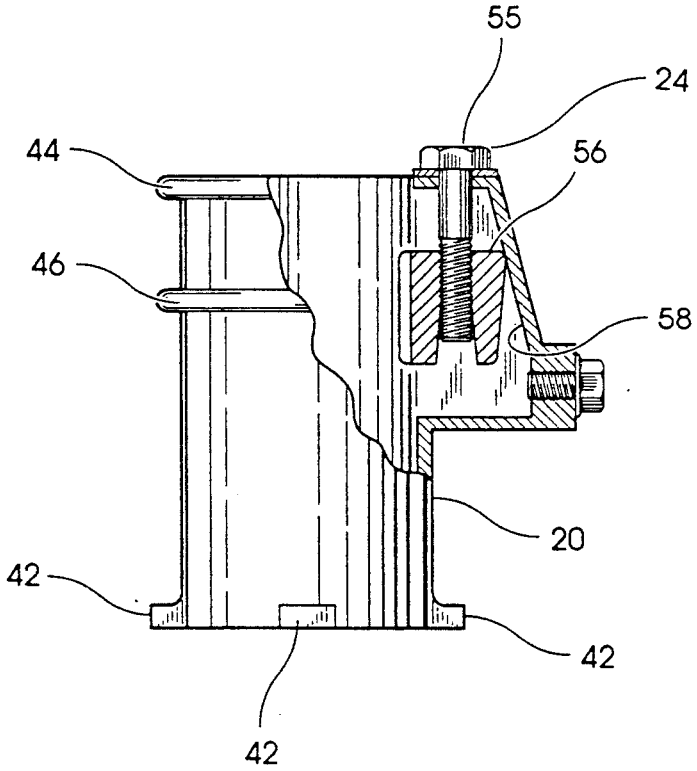
FIG. 6 is a side elevational, partial cross-sectional view of the built-in anchor shown in FIG. 3.

Referring now to FIGS. 5 and 6, the clamping mechanism of anchor 20 is shown in greater detail. Clamp 24 includes a bolt 55 threadedly engaged with a weighted clamp member 56. As bolt 55 is tightened, clamp member 56 is advanced upward and forced radially inward by the wedging action provided by tapered surface 58. Conversely, by loosening bolt 55 clamp member 56 is retracted downward and out of clamping contact against tapered surface 58. By employing a clamp member 56 adjustable in a wedge-like fashion against a tapered surface 58, anchor 20 provides a clamping force normal to the support pole via the top mounted adjusting bolt 55. As such, anchor 20 can be mounted flush with deck 11 while still permitting clamping adjustment via the top mounted bolt.

In addition to the rigid mounting provided by the aforementioned anchoring system, other improvements are contemplated to improve the durability and performance of the netted game pieces for use with a dedicated activity pool. For example, referring now to FIG. 7 the construction and mounting of net 12 is shown in greater detail. Net 12 includes a top sleeve 60 and a bottom sleeve 62 that extend the length of the net. Unlike prior netted accessories which attach to ends of the net and rely on the net itself to transmit and react loads thereacross, net 12 is received over top and bottom net cords 64 and 66 which extend beyond the ends of sleeves 60 and 62 for mounting to the support poles. The top and bottom net cords react the assembly loads required to support the net taught over the pool, as well as any additional loads that might be generated during play across the net to provide a stronger volleyball net specifically adapted for the rigorous environment of poolside volleyball.

Figure 7:
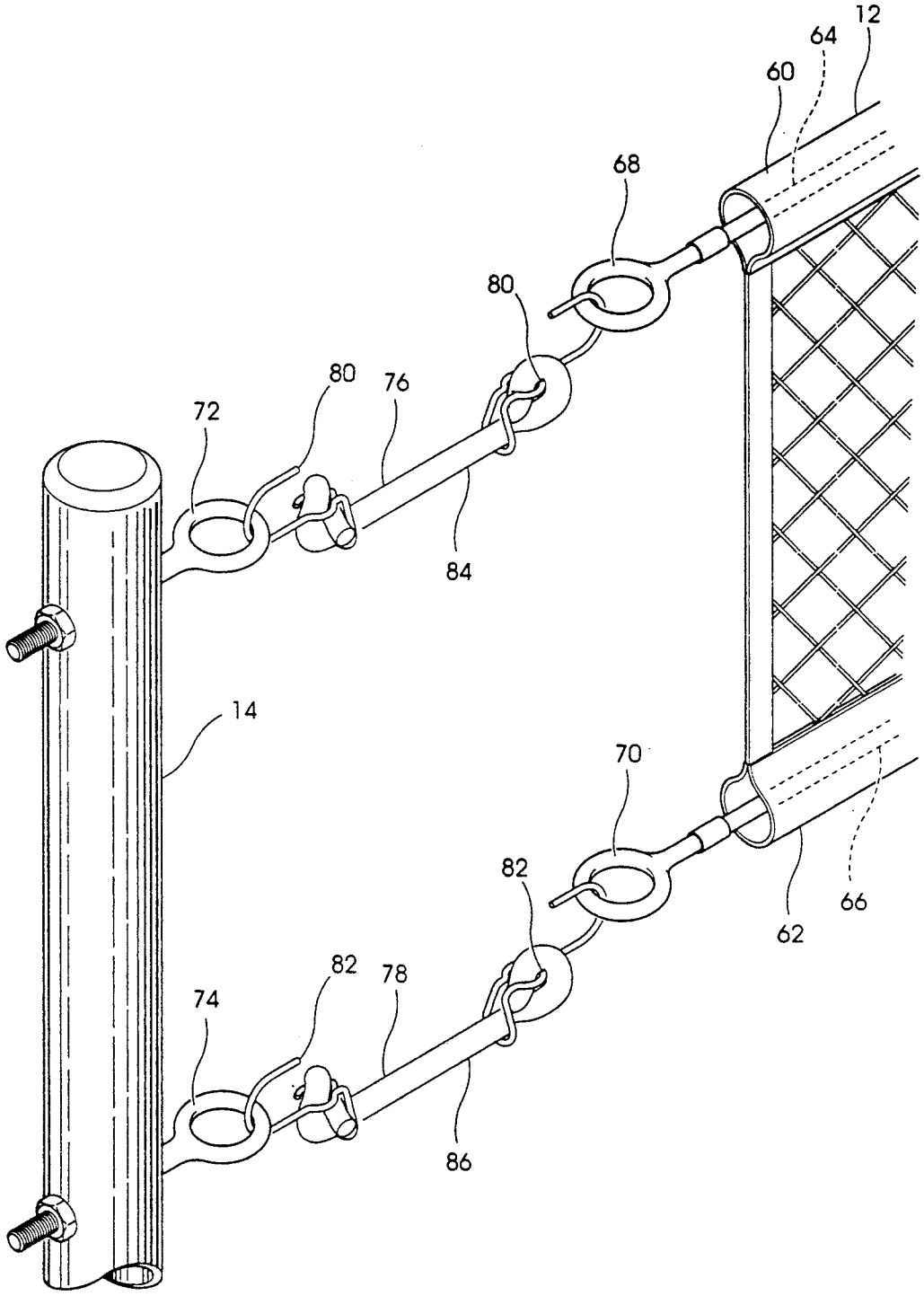
FIG. 7 is a partial side elevational view of the volleyball net shown in FIG. 1 depicting its attachment.

In FIG. 7, top and bottom net cords 64 and 66 include eyelets 68 and 70, respectively, for mounting net 12 across a pool. Corresponding top and bottom mounting eyelets 72 and 74 are attached to support pole 14 for receiving net 12 mounted thereon. Resiliently flexible tie down hooks 76 and 78 connect between the mounting eyelets 72 and 74 and the net cord eyelets 68 and 70 to mount net 12 to support pole 14. As shown in FIG. 7, tie down hooks 76 and 78 include metal hooks 80 and 82 connected together by resiliently flexible cords 84 and 86, respectively. In the preferred embodiment, resiliently flexible cords 84 and 86 are constructed from a resilient rubber or rubber-like material. Similar net cord eyelets, mounting eyelets, and resiliently flexible tie down hooks are provided for mounting the opposite end of the net to support pole 16 (not shown).

Figure 8:
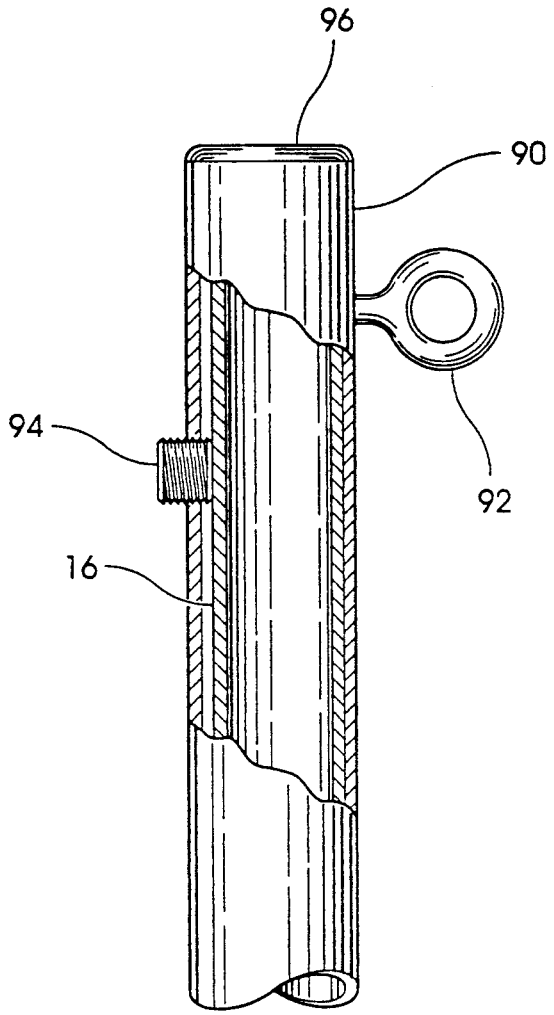
FIG. 8 is a side elevational, partial cross-sectional view of an alternate telescoping mounting arrangement for the volleyball net shown in FIG. 1.

Still other improvements are contemplated to improve the performance of a volleyball net mounted across an activity pool. In addition to the adjustable support means shown in FIG. 4, other means for adjusting the height of the support tubing are contemplated for use with anchor 20. For example, referring now to FIG. 8, support pole 16 is shown having a telescoping outer sleeve 90 slideably mounted thereover. Volleyball net 12 mounts to sleeve 90 via eyelet or eye hook 92. Eye hook 92 is fastened to sleeve 90 rather than to support pole 16. The attachment means for mounting eye hook 92 to sleeve 90 does not exceed the annular clearance provided between support pole 16 and sleeve 90 so that sleeve 90 is free to slide along the length of support pole 16. In this embodiment, eye hook 92 is lockably threaded into sleeve 90 to attach thereto. Set screw 94 is similarly threaded into sleeve 90 and is adjustable to selectively lock sleeve 90 relative to support pole 16. Additionally, caps such as cap 96 for sleeve 90 (FIG. 8) are provided for sealing the ends of the support poles and for presenting a rounded edge protective against injury to the user.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A support system for mounting a netted water sport game piece from a deck of a pool, comprising:

a netted water sport game piece adapted for recreational use with a pool;

a first elongated member for supporting said netted water sport game piece from at least one edge of the pool, said first elongated member including a cylindrical portion having a diameter in the range of about 1.85 to 1.95 inches;

means for mounting said netted water sport game piece to said first elongated member; and a built-in anchor mounted in the deck of the pool, said built-in anchor including;

a top surface disposed substantially flush with the deck of the pool;

a longitudinal bore extending downwardly from said top surface, said longitudinal bore having a predetermined common diameter sized for receiving said cylindrical portion therein; and an adjustable clamp accessible from said top surface for clamping said cylindrical portion in place in said longitudinal bore.

2. The support system of claim 1, and further comprising a second elongated member for supporting said netted water sport game piece from an edge opposite the at least one edge wherein said netted water sport game piece includes a volleyball net mounted between said first and said second elongated members.

3. The support system of claim 2, wherein said volleyball net includes:

a top sleeve extending the length of said net;

a top net cord received through said top sleeve and having first and second top net cord ends extending beyond sleeve ends of said top sleeve for mounting said volleyball net between said first and said second elongated members;

a bottom sleeve extending the length of said net; and a bottom net cord received through said bottom sleeve and having first and second bottom net cord ends extending beyond sleeve ends of said bottom sleeve for mounting said volleyball net between said first and said second elongated members.

4. The support system of claim 3, wherein said means for mounting includes:

first and second top net cord eyelets attached at said first and said second top net cord ends, respectfully, and first and second bottom net cord eyelets attached at said first and second bottom net cord ends, respectfully;

first and second top mounting eyelets attached at top ends of said first and second elongated members, respectfully, and first and second bottom mounting eyelets attached at bottom ends of said first and said second elongated members, respectfully; and first and second resiliently flexible top tie down hooks connected between said first and second top net cord eyelets and said first and second top mounting eyelets, respectfully, and first and second resiliently flexible bottom tie down hooks connected between said first and second bottom net cord eyelets and said first and second bottom mounting eyelets, respectfully.

5. The support system of claim 1, wherein said netted water sport game piece includes a basketball goal attached to said first elongated member.

6. The support system of claim 5, and further comprising:

a collar slideably disposed about said cylindrical portion of said first elongated member; and means for locking said collar to said cylindrical portion of said first elongated member;

wherein said collar is selectively lockable along said cylindrical portion to adjust said first elongated member within said longitudinal bore of said built-in anchor, said collar resting on said built-in anchor when locked to said cylindrical portion to fix the height of said basketball goal above said built-in anchor.

7. The support system of claim 6, wherein said first elongated member is constructed from cylindrical tubing having a vertical segment for receipt in said longitudinal bore and an angled segment for supporting said basketball goal over the pool, said angled segment being at an angle of about 45 degrees relative to said vertical segment.

8. The support system of claim 1, wherein said first elongated member is constructed from 0.145 inch gauge stainless steel tubing having a diameter of 1.90 inches.

9. A support system for mounting a volleyball net from a deck of a pool, comprising:

a volleyball net adapted for recreational use with a pool;

first telescoping means for adjustably supporting an end of said volleyball net above the pool;

second telescoping means for adjustably supporting the other end of said volleyball net above the pool;

means for mounting said volleyball net between said first and said second telescoping means; and anchor means, mounted in the deck of the pool, for anchoring said first and said second telescoping means to the deck of the pool.

10. The support system of claim 9, wherein:

each of said first and said second telescoping means includes a cylindrical portion having a diameter in the range of about 1.85 to 1.95 inches; and said anchor means includes first and second built-in anchors mounted opposite one another in the deck of the pool, each of said first and second built-in anchors including;

a top surface disposed substantially flush with the deck of the pool;

a longitudinal bore extending downwardly from said top surface, said longitudinal bore having a predetermined common diameter sized for receiving said cylindrical portion therein; and an adjustable clamp accessible from said top surface for clamping said cylindrical portion in place in said longitudinal bore.

11. The support system of claim 10, wherein each of said first and said second telescoping means includes:

an inner cylindrical tube having a diameter in the range of about 1.85 to 1.95 inches;

an outer cylindrical tube slideably received over said inner cylindrical tube, said volleyball net being mounted to said outer cylindrical tube; and means for selectively locking said outer cylindrical tube to said inner cylindrical tube.

12. The support system of claim 11, wherein said inner cylindrical tube is constructed from 0.145 inch gauge stainless steel tubing having a diameter of 1.90 inches.

13. The support system of claim 9, wherein said volleyball net includes:

a top sleeve extending the length of said net;

a top net cord received through said top sleeve and having first and second top net cord ends extending beyond sleeve ends of said top sleeve for mounting said volleyball net between said first and second elongated members;

a bottom sleeve extending the length of said net; and a bottom net cord received through said bottom sleeve and having first and second bottom net cord ends extending beyond sleeve ends of said bottom sleeve for mounting said volleyball net between said first and second elongated members.

14. The support system of claim 13, wherein said means for mounting includes:

first and second top net cord eyelets attached at said first and second top net cord ends, respectfully, and first and second bottom net cord eyelets attached at said first and second bottom net cord ends, respectfully;

first and second top mounting eyelets attached at top ends of said first and second elongated members, respectfully, and first and second bottom mounting eyelets attached at bottom ends of said first and second elongated members, respectfully; and first and second resiliently flexible top tie down hooks connected between said first and second top net cord eyelets and said first and second top mounting eyelets, respectfully, and first and second resiliently flexible bottom tie down hooks connected between said first and second bottom net cord eyelets and said first and second bottom mounting eyelets, respectfully.

15. A method for mounting a netted water sport game piece from a deck of a pool, comprising the steps of:

obtaining a netted water sport game piece for recreational use with a pool, said game piece being mounted to a first elongated member that includes a cylindrical portion having a diameter in the range of about 1.85 to 1.95 inches;

inserting said cylindrical portion into a built-in anchor mounted in the deck of the pool, said built-in anchor including a top surface disposed substantially flush with the deck of the pool, a downwardly extending longitudinal bore having a predetermined common diameter sized for receiving said cylindrical portion, and an adjustable clamp accessible from said top surface adapted for clamping said cylindrical portion in place in said longitudinal bore; and adjusting said adjustable clamp to clamp said cylindrical portion in place in said longitudinal bore.

16. The method of claim 15, and further comprising the step of mounting said built-in anchor in the deck of the pool at a location particularly suited for receiving said netted water sport game piece.

17. The support system of claim 15, wherein in the step of obtaining a netted water sport game piece, said game piece includes a volleyball net.

18. The support system of claim 15, wherein in the step of obtaining a netted water sport game piece, said game piece includes a basketball goal.

* * * * *